US008035563B2

(12) United States Patent
Ishimiya

(10) Patent No.: US 8,035,563 B2
(45) Date of Patent: Oct. 11, 2011

(54) MULTIBAND ANTENNA DEVICE AND COMMUNICATION TERMINAL DEVICE

(75) Inventor: Katsunori Ishimiya, Tokyo (JP)

(73) Assignee: Sony Ericsson Mobile Communications Japan, Inc., Tokyo (JP)

( * ) Notice: Subject to any disclaimer, the term of this patent is extended or adjusted under 35 U.S.C. 154(b) by 387 days.

(21) Appl. No.: 12/089,922

(22) PCT Filed: Sep. 22, 2006

(86) PCT No.: PCT/JP2006/318859

§ 371 (c)(1),
(2), (4) Date: Apr. 11, 2008

(87) PCT Pub. No.: WO2007/049414

PCT Pub. Date: May 3, 2007

(65) Prior Publication Data

US 2009/0231213 A1 Sep. 17, 2009

(30) Foreign Application Priority Data

Oct. 25, 2005 (JP) ..... 2005-309345

(51) Int. Cl.
*H01Q 1/24* (2006.01)

(52) U.S. Cl. ..... 343/700 MS; 343/702; 343/846

(58) Field of Classification Search ..... 343/700 MS, 343/702, 846

See application file for complete search history.

(56) References Cited

U.S. PATENT DOCUMENTS

| | | | | |
|---|---|---|---|---|
| 5,872,546 | A * | 2/1999 | Ihara et al. | 343/795 |
| 6,320,545 | B1 | 11/2001 | Nagumo et al. | |
| 2004/0056804 | A1 | 3/2004 | Kadambi et al. | |
| 2004/0207557 | A1 | 10/2004 | Chen et al. | |
| 2005/0280588 | A1 * | 12/2005 | Fujikawa et al. | 343/702 |

FOREIGN PATENT DOCUMENTS

| | | | |
|---|---|---|---|
| CN | 1279521 | A | 1/2001 |
| DE | 103 41 310 | A1 | 3/2004 |
| EP | 1 267 441 | A2 | 12/2002 |
| EP | 1 478 047 | A1 | 11/2004 |
| JP | 36 12823 | | 5/1961 |
| JP | 62 161410 | | 10/1987 |

(Continued)

OTHER PUBLICATIONS

T. Sittironnarit, et al. "A Dual-Band Vehicular Planar Inverted-F Antenna for Ultra High Frequency (UHF) Applications", IEEE, 55th Vehicular Technology Conference, Proceedings, vol. 1, XP 001210405, May 6, 2002, pp. 345-349.

(Continued)

*Primary Examiner* — David G Phan

(74) *Attorney, Agent, or Firm* — Oblon, Spivak, McClelland, Maier & Neustadt, L.L.P.

(57) ABSTRACT

A slit (15) is formed between a feed point and GND point of an inverted-F antenna to make the points electrically distant from each other, and at least three antenna elements (14*a*, 14*b*, and 14*c*) are formed. The at least three antenna elements (14*a*, 14*b*, and 14*c*) generate at least three resonance points. An antenna radiating plate (3) projects outwardly so that at least a major part thereof does not face a ground plate (4). Therefore, a multi-band antenna device capable of achieving a wider bandwidth without using a parasitic element, and a communication terminal apparatus are provided.

4 Claims, 10 Drawing Sheets

FOREIGN PATENT DOCUMENTS

| | | |
|---|---|---|
| JP | 6-181997 | 7/1994 |
| JP | 7 14714 | 3/1995 |
| JP | 7 288422 | 10/1995 |
| JP | 10-93332 | 4/1998 |
| JP | 10 93332 | 4/1998 |
| JP | 10-173426 | 6/1998 |
| JP | 11 284430 | 10/1999 |
| JP | 2000 68736 | 3/2000 |
| JP | 2001 68917 | 3/2001 |
| JP | 2001 251128 | 9/2001 |
| JP | 2001 358517 | 12/2001 |
| JP | 2002 299933 | 10/2002 |
| JP | 2002 344233 | 11/2002 |
| JP | 2003 516650 | 5/2003 |
| JP | 2003 309417 | 10/2003 |
| JP | 3503556 | 12/2003 |
| JP | 2004-112029 | 4/2004 |
| JP | 2004 228640 | 8/2004 |
| JP | 2004 320706 | 11/2004 |
| JP | 3656470 | 3/2005 |
| WO | WO 01/17063 A1 | 3/2001 |
| WO | WO 02/078123 A1 | 10/2002 |
| WO | WO 2004/038857 A1 | 5/2004 |
| WO | 2004 109857 | 12/2004 |
| WO | WO 2005/048404 A1 | 5/2005 |

OTHER PUBLICATIONS

Office Action issued Jan. 5, 2011, in European Patent Application No. 06 798 247.0-2220.

European Search Report issued Nov. 25, 2010 in European Application No. 10 01 0962.

* cited by examiner (a)

(b)

(c)

MULTIBAND ANTENNA DEVICE AND COMMUNICATION TERMINAL DEVICE

TECHNICAL FIELD

The present invention relates to a multi-band antenna device mounted in a wireless communication terminal such as a portable telephone and supporting multiple bands and to a communication terminal apparatus using the multi-band antenna device.

BACKGROUND ART

A planar inverted-F antenna (PIFA) type is mainly used in a multi-band built-in antenna which supports communication in a plurality of frequency bands using a single wireless communication terminal (see Japanese Unexamined Utility Model Registration Application Publication No. 7-14714 and Japanese Unexamined Patent Application Publication No. 2002-344233).

Furthermore, to achieve a wider bandwidth, antennas including a parasitic element connected to a ground (GND) plate have been dominant (see Japanese Unexamined Utility Model Registration Application Publication No. 62-161410).

DISCLOSURE OF INVENTION

However, although the use of a parasitic element as disclosed in Japanese Unexamined Utility Model Registration Application Publication No. 62-161410 is suitable for a wider bandwidth, loss in radiation efficiency is large because the parasitic element is connected to the ground plate.

The present invention has been made in view of such a situation, and provides a multi-band antenna device in which a wider bandwidth can be achieved without using a parasitic element, and a communication terminal apparatus.

A multi-band antenna device according to the present invention is characterized by including an antenna radiating plate having a feed point and a GND point, and a ground plate, wherein the antenna radiating plate is configured such that the feed point and the GND point are electrically distant from each other, that at least three antenna elements are formed, and that at least a major part of the antenna radiating plate does not face the ground plate.

Since the feed point and the GND point are electrically distant from each other and at least three antenna elements are formed, at least three resonance points are generated, which enables multiple bands. Further, the antenna radiating plate is configured such that an almost entire portion thereof does not face the ground plate, whereby the constraint on the thickness of the antenna device is reduced and the amount of current flowing in the ground plate is reduced.

BEST MODE FOR CARRYING OUT THE INVENTION

A preferred embodiment of the present invention will be described in detail hereinafter with reference to the drawings.

Figure 1:
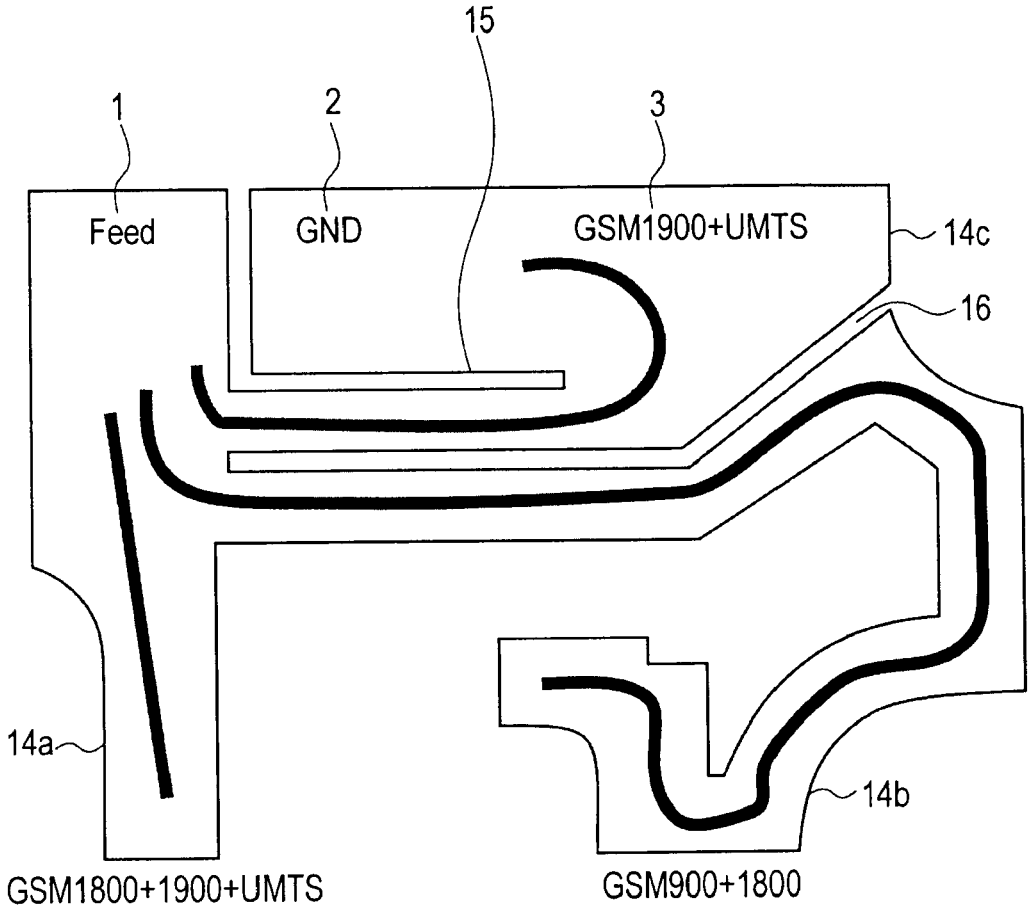
FIG. 1 is a diagram showing an example structure of antenna elements in an antenna device according to an embodiment of the present invention.

FIG. 1 shows an example structure of antenna elements in an antenna device according to the embodiment. The antenna device of the present invention is an inverted-F antenna device which uses, together with a GND plate described below, a plate-shaped antenna radiating plate 3 having a feed point 1 and a GND point 2. An antenna structure of the antenna device has a feature of having at least three segmented antenna elements 14*a*, 14*b*, and 14*c*. Thus, the antenna device is provided with a slit 15 formed between the feed point 1 and the GND point 2, and a slit 16 by which the antenna elements 14*b* and 14*c* are separated. In particular, the slit 15 serves to make the feed point and the GND point electrically distant from each other. A resonance frequency is adjustable by the length of each antenna element. The antenna elements may be composed of sheet metal or may be formed of a flexible substrate.

Figure 7:
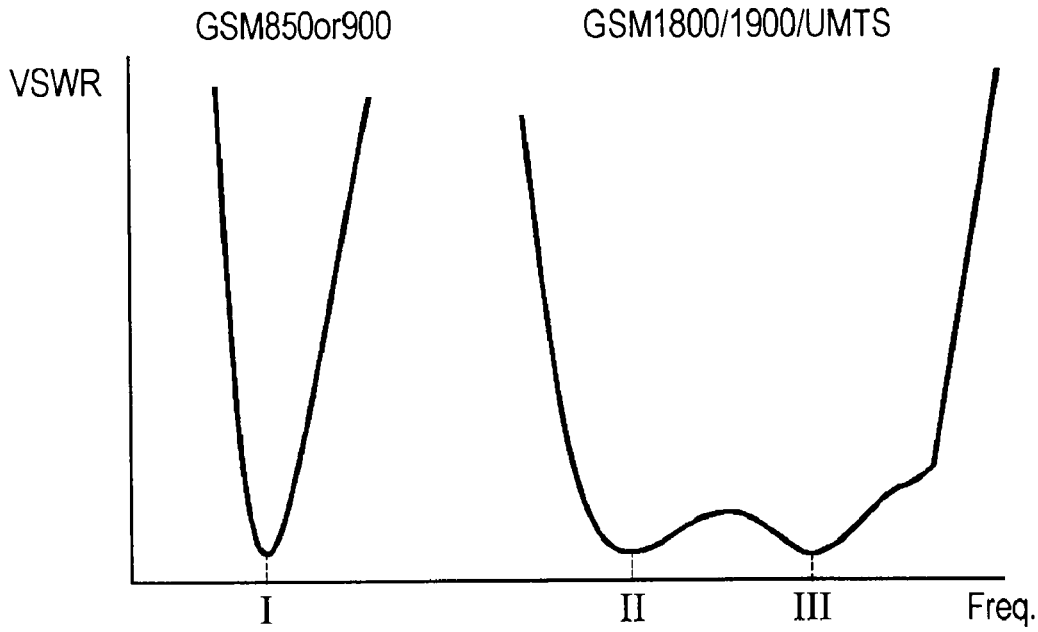
FIG. 7 is a graph showing a voltage standing wave ratio (VSWR) versus frequency (Freq.) characteristic of an antenna device according to an embodiment of the present invention.

With the structure shown in FIG. 1, as shown in a graph of FIG. 7 showing a voltage standing wave ratio (VSWR) versus frequency (Freq.) characteristic, three resonance points I, II, and III are obtained. Therefore, an antenna device supporting different frequency bands (GSM (Global System for Mobile Communications) 850 or 900, GSM 1800/1900/UMTS (Universal Mobile Telecommunications System) is achieved.

Figure 2:
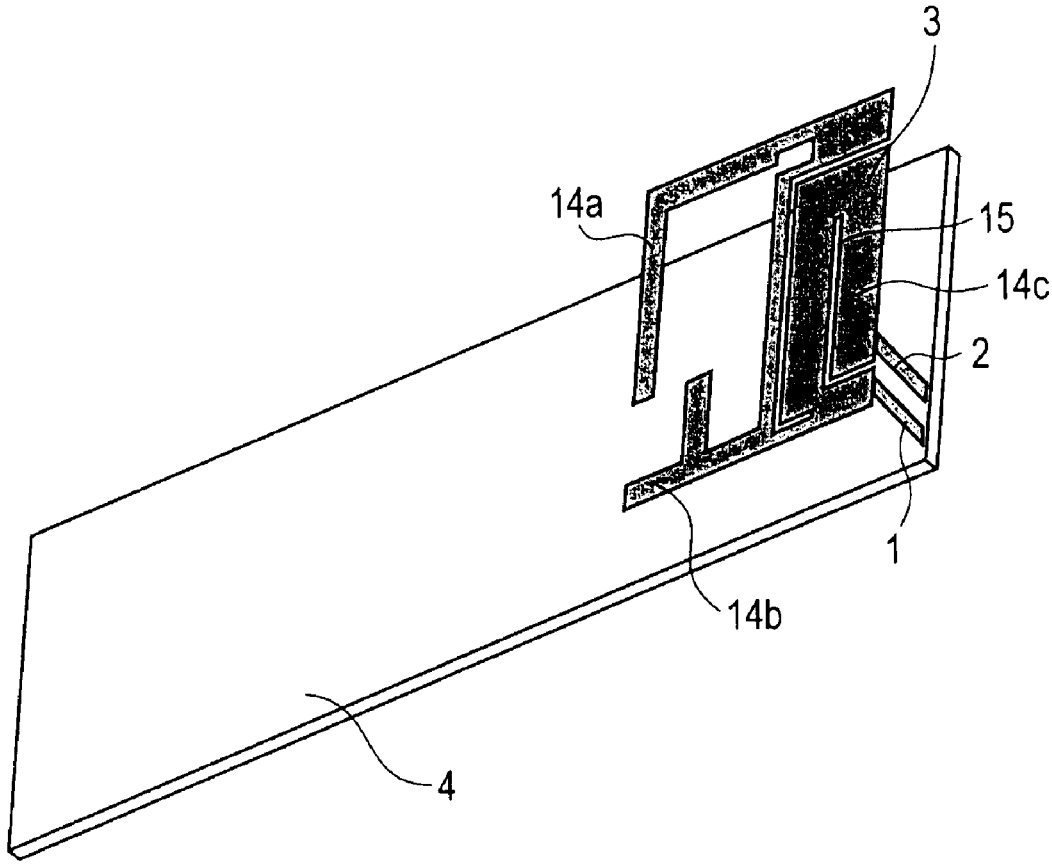
FIG. 2 is a perspective view showing a schematic structure of an antenna device according to an embodiment of the present invention.

FIG. 2 is a perspective view showing a schematic structure of the antenna device according to the embodiment. An antenna radiating plate 3 of the antenna device has a different shape from that shown in FIG. 1 but is common to the antenna radiating plate 3 shown in FIG. 1 in that it includes at least three segmented antenna elements 14*a*, 14*b*, and 14*c*. The antenna radiating plate 3 is connected to a GND plate 4 (conductor side of a substrate of a terminal) via a feed point 1 and a GND point 2.

Figure 3:
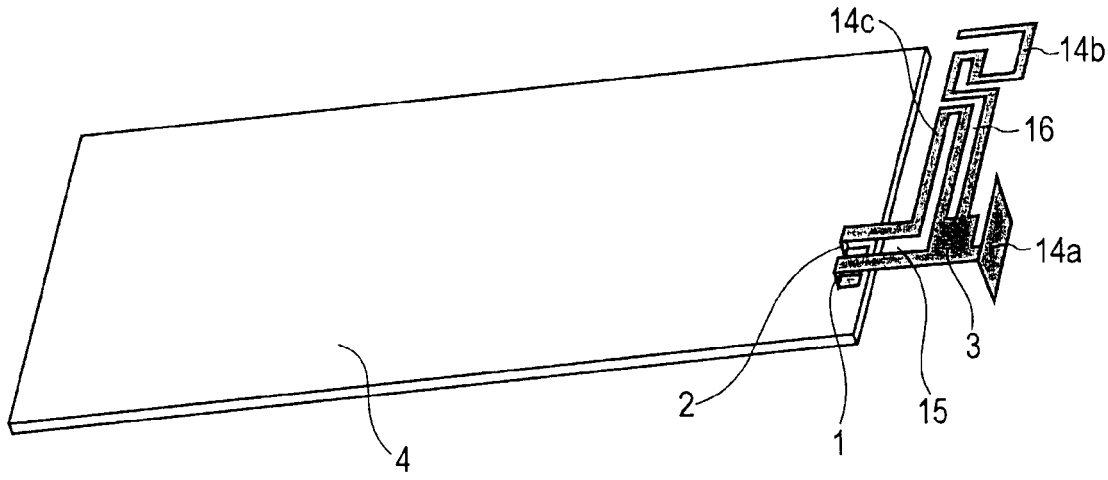
FIG. 3 is a perspective view showing an antenna device having a structure different from that shown in FIG. 2.

FIG. 3 shows an antenna device having a structure different from that shown in FIG. 2. An antenna radiating plate 3 of the antenna device has a different shape from the antenna radiating plate shown in FIG. 2 but is common to the antenna radiating plate 3 shown in FIG. 1 in that it includes at least three segmented antenna elements 14*a*, 14*b*, and 14*c*. The difference between the antenna device shown in FIG. 3 and the antenna device shown in FIG. 2 is as follows. In the structure shown in FIG. 2, the antenna radiating plate 3 projects to the inside of the GND plate 4 with respect to the feed point 1 and the GND point 2. In the structure shown in FIG. 3, on the other hand, the antenna radiating plate 3 projects outwardly to the outside. In addition, the antenna radiating plate 3 projects to the outside so that at least a major part of the antenna radiating plate 3 does not face the ground plate 4. That is, no portion of the GND plate 4 corresponds to at least a main portion of the antenna radiating plate 3. In the structure shown in FIG. 2, due to antenna characteristics, a height h1 of the antenna radiating plate 3, measured from the GND plate 4, needs to have a predetermined value. In the structure shown in FIG. 3, however, a height h2 measured from a position equivalent to the GND plate 4 to the antenna radiating plate 3 may be small (that is, h1>h2). In the extreme case, the antenna radiating plate 3 may be positioned at the same height as the GND plate 4 (that is, h2=0). This means that the constraint on the thickness of a housing of a terminal, which arises due to the existence of an antenna device, is released. Note that, in FIG. 3, a leading end portion of the antenna element 14*a* is bent at a right angle. This reduces the amount of projection of the antenna radiating plate 3. However, this bending is not essential to the present invention.

Figure 4:
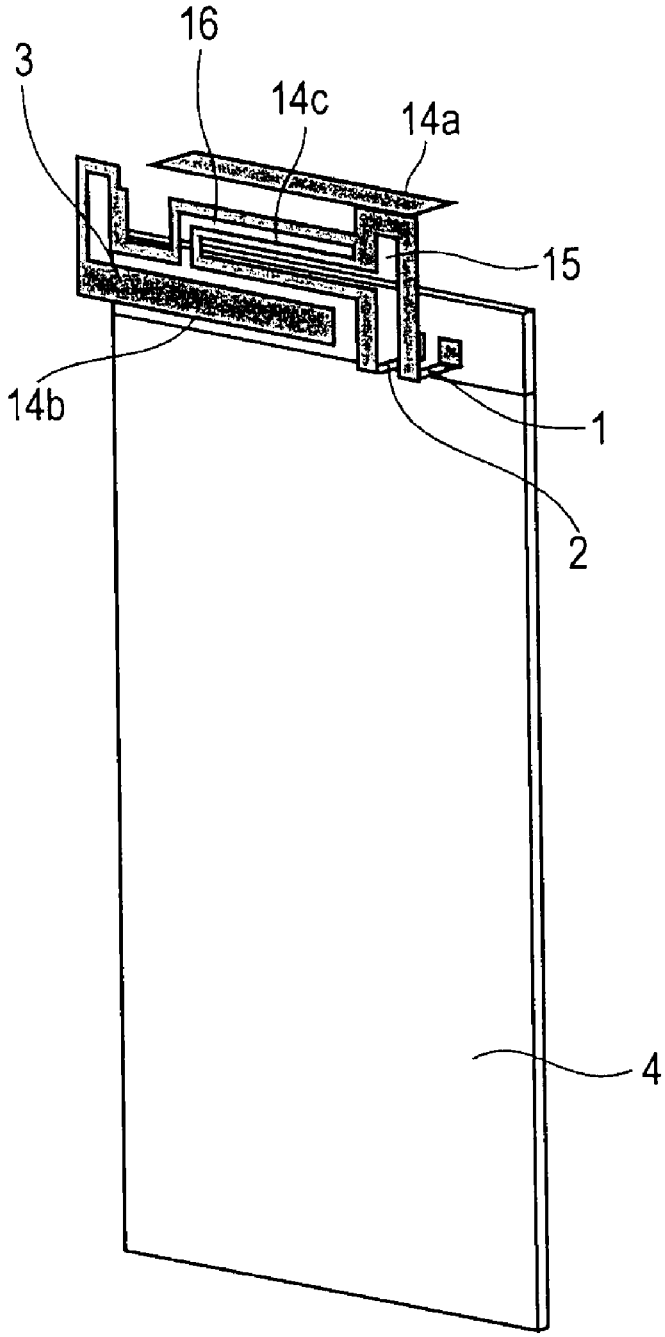
FIG. 4 is a perspective view showing another example structure of an antenna device in which, similarly to that shown in FIG. 3, an antenna radiating plate projects to the outside of a GND plate with respect to a feed point and a GND point.

FIG. 4 shows another example structure of an antenna device in which, similarly to that shown in FIG. 3, an antenna radiating plate 3 projects to the outside of a GND plate 4 with respect to a feed point 1 and a GND point 2. The antenna radiating plate 3 has a different shape from any of the above-described antenna radiating plates but is common to the antenna radiating plate 3 shown in FIG. 1 in that it includes at least three segmented antenna elements 14*a*, 14*b*, and 14*c*. In the example shown in FIG. 4, similarly to that shown in FIG. 3, a height h2 measured to the antenna radiating plate 3 may be small, and the constraint on the thickness of a housing of a terminal, which arises due to the existence of an antenna device, is released.

Figure 5:
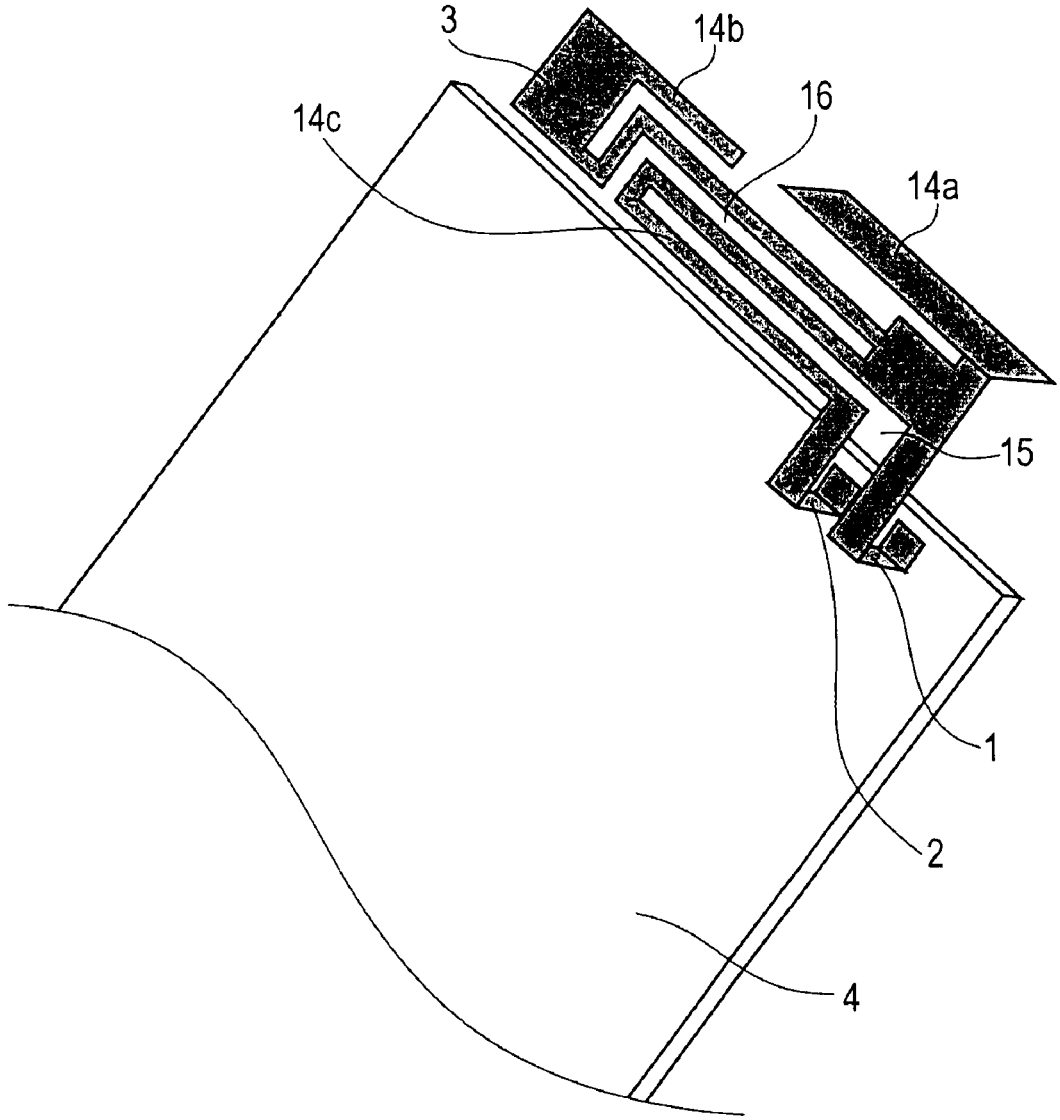
FIG. 5 is a diagram showing an example structure of still another antenna device similar to the antenna device shown in FIG. 4 but including an antenna radiating plate having a different shape.

FIG. 5 shows an example structure of still another antenna device similar to the antenna device shown in FIG. 4 but including an antenna radiating plate 3 having a different shape.

Figure 6:
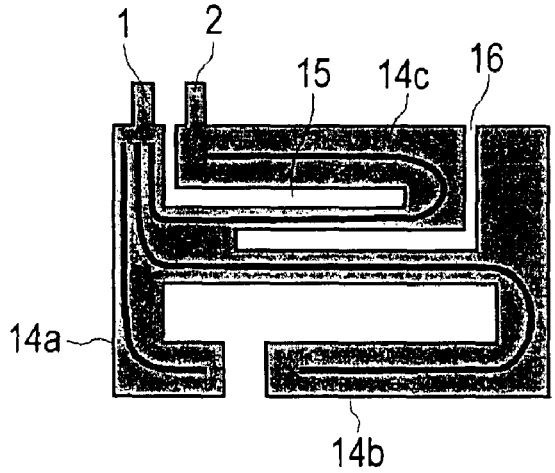
FIG. 6 includes diagrams showing examples of different shapes of still other antenna radiating plates having the characteristics shown in FIG. 1.
Figure 6:
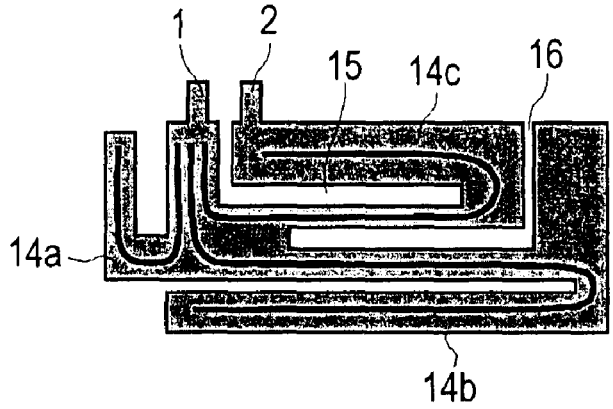
Figure 6:
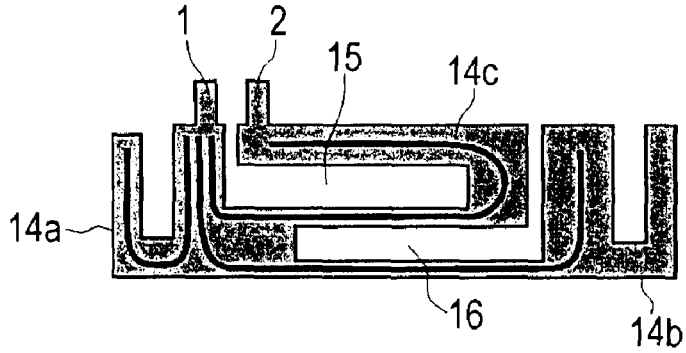

FIG. 6 shows examples of different shapes of still other antenna radiating plates having the characteristics shown in FIG. 1. Any of the antenna radiating plates includes at least three segmented antenna elements 14*a*, 14*b*, and 14*c*.

Figure 8:
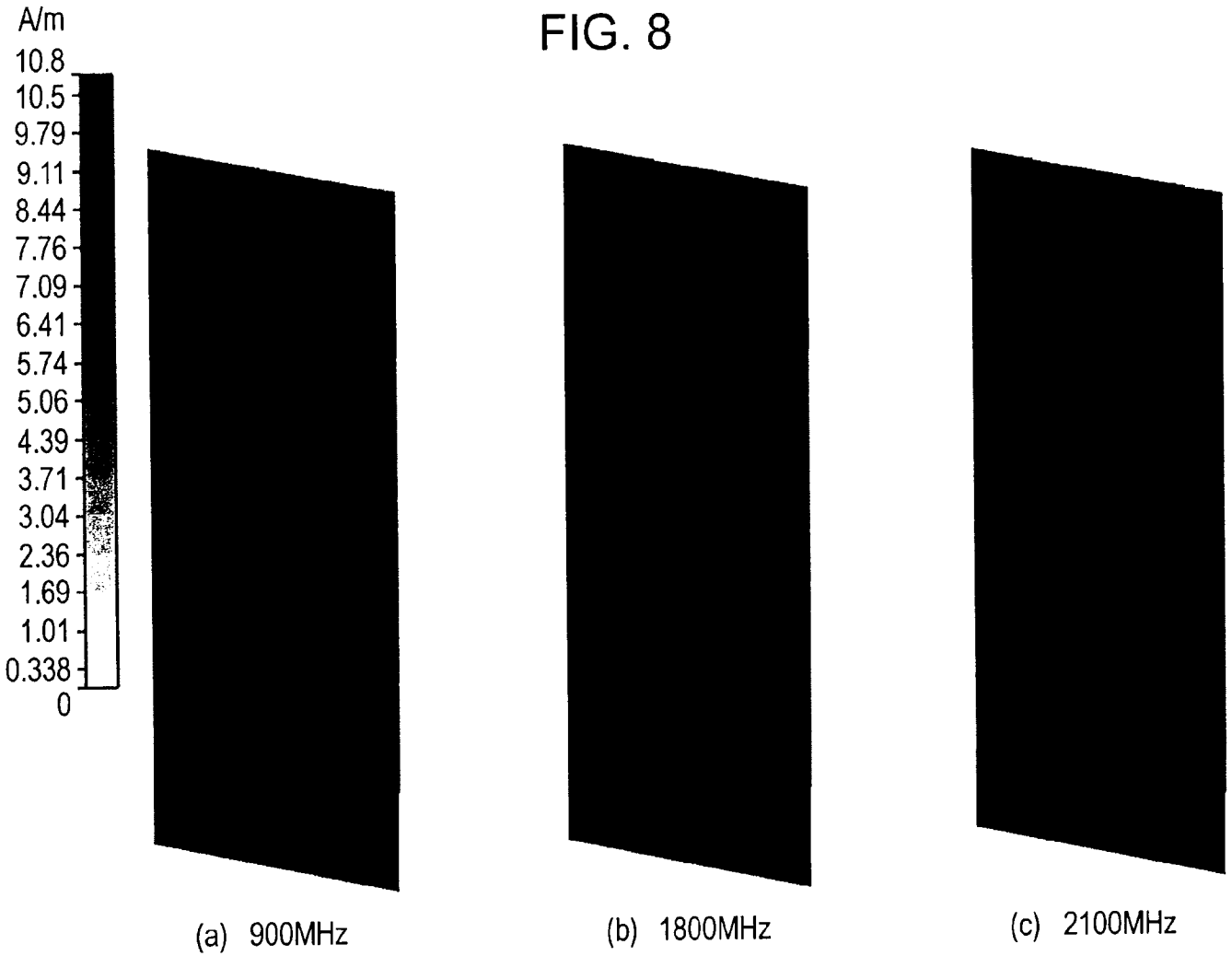
FIG. 8 is a graph showing results of simulation of a current distribution over a GND plate of the antenna device shown in FIG. 2 in different frequency bands, (a) 900 MHz, (b) 1800 MHz, and (c) 2100 MHz.

FIG. 8 shows results of simulation of a current distribution over the GND plate of the antenna device shown in FIG. 2 in different frequency bands, (a) 900 MHz, (b) 1800 MHz, and (c) 2100 MHz. As can be seen from FIG. 8, it is found that the current distribution over the GND plate is different depending on the frequency band.

Figure 9:
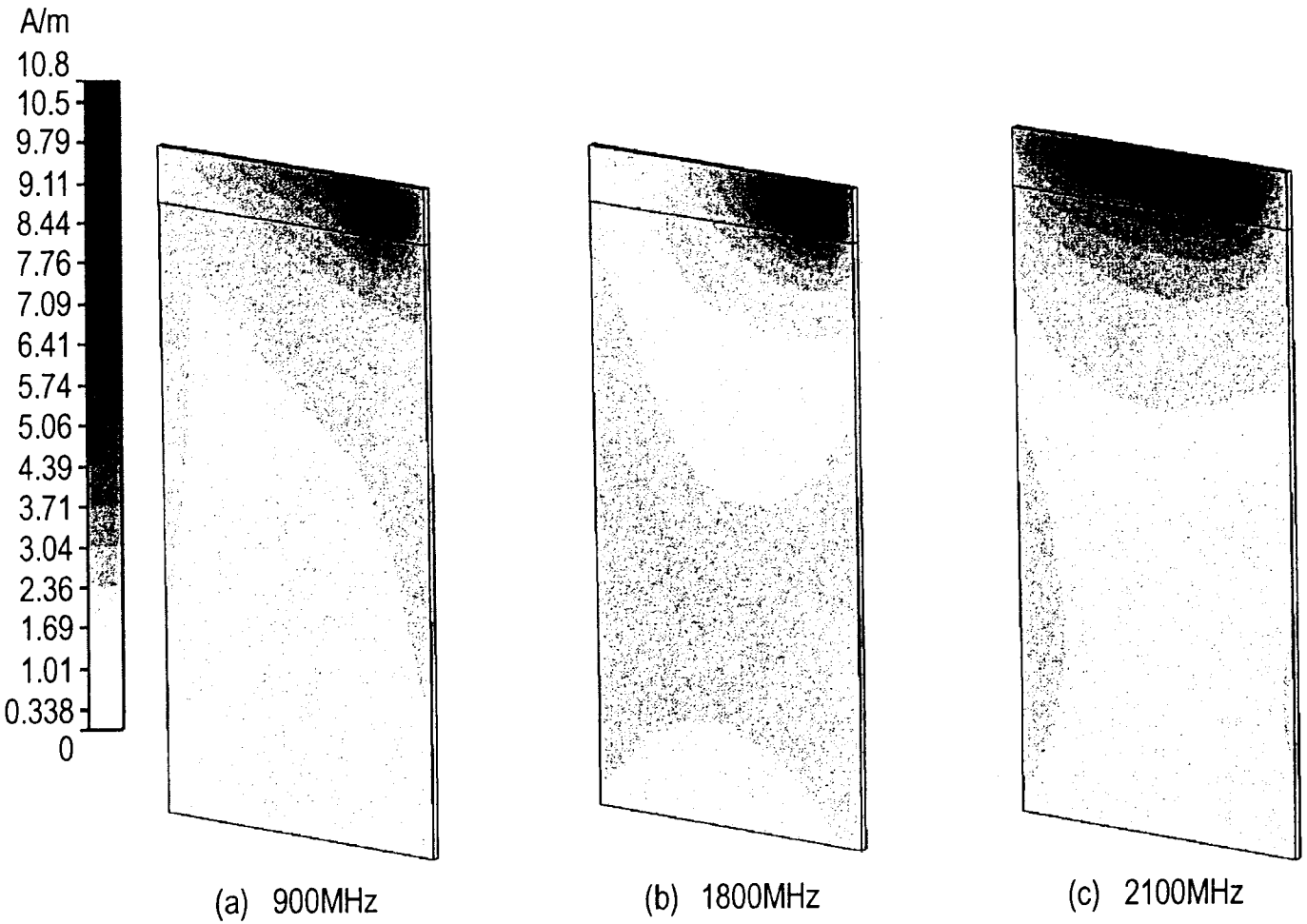
FIG. 9 is a graph showing results of simulation of a current distribution over the GND plate of the antenna device shown in FIG. 4 in different frequency bands, (a) 900 MHz, (b) 1800 MHz, and (c) 2100 MHz.

FIG. 9 shows results of simulation of a current distribution over the GND plate of the antenna device shown in FIG. 4 in different frequency bands, (a) 900 MHz, (b) 1800 MHz, and (c) 2100 MHz. As can also be seen from FIG. 9, the current distribution over the GND plate is different depending on the frequency band. It is also found that the amount of current flowing over the GND plate is significantly smaller than that in the results shown in FIG. 8. This may result from a structure in which, like an antenna device such as that shown in FIG. 4, there is no GND plate facing the antenna radiating plate 3. Such a structure, therefore, is advantageous in that, when compared with the structure shown in FIG. 2, there is less effect on the current flowing in the GND plate even if a user holds the terminal with their hand, that is, the so-called hand effect can be reduced.

Advantages of the embodiment are summarized as follows.

1. With the use of an antenna discharging plate having the features shown in FIG. 1 for an inverted-F antenna, a large number of resonance points are generated without using a parasitic element, and a wider bandwidth in a high-frequency band (1.7/2.2 GHz) of a portable telephone is achieved.

In other words, multi-band characteristics can be obtained. For example, the following combinations are conceivable:

GSM 850/1800/1900
GSM 900/1800/1900
GSM 850/1800/1900/UMTS
GSM 900/1800/1900/UMTS
GSM 850/900/1800/1900
GSM 850/900/1800/1900/UMTS, etc.

2. Since no parasitic element is used, loss in radiation efficiency is low. In other words, improvement in performance can be realized.
3. It is not necessary to use a contact pin for a parasitic element. Thus, reduction in cost is realized.
4. The antenna device can be operated even if no GND plate is disposed below a radiating plate. Thus, antenna size can be reduced.
5. Since a resonance frequency is adjustable by the length of an antenna element, it is easy to design the antenna device.
6. With the use of a flexible substrate as an antenna element, the antenna device can be easily produced by designing and manufacturing.
7. The antenna device is applicable to various shapes of portable terminals such as a bar-shaped terminal and a foldable terminal.

Figure 10:
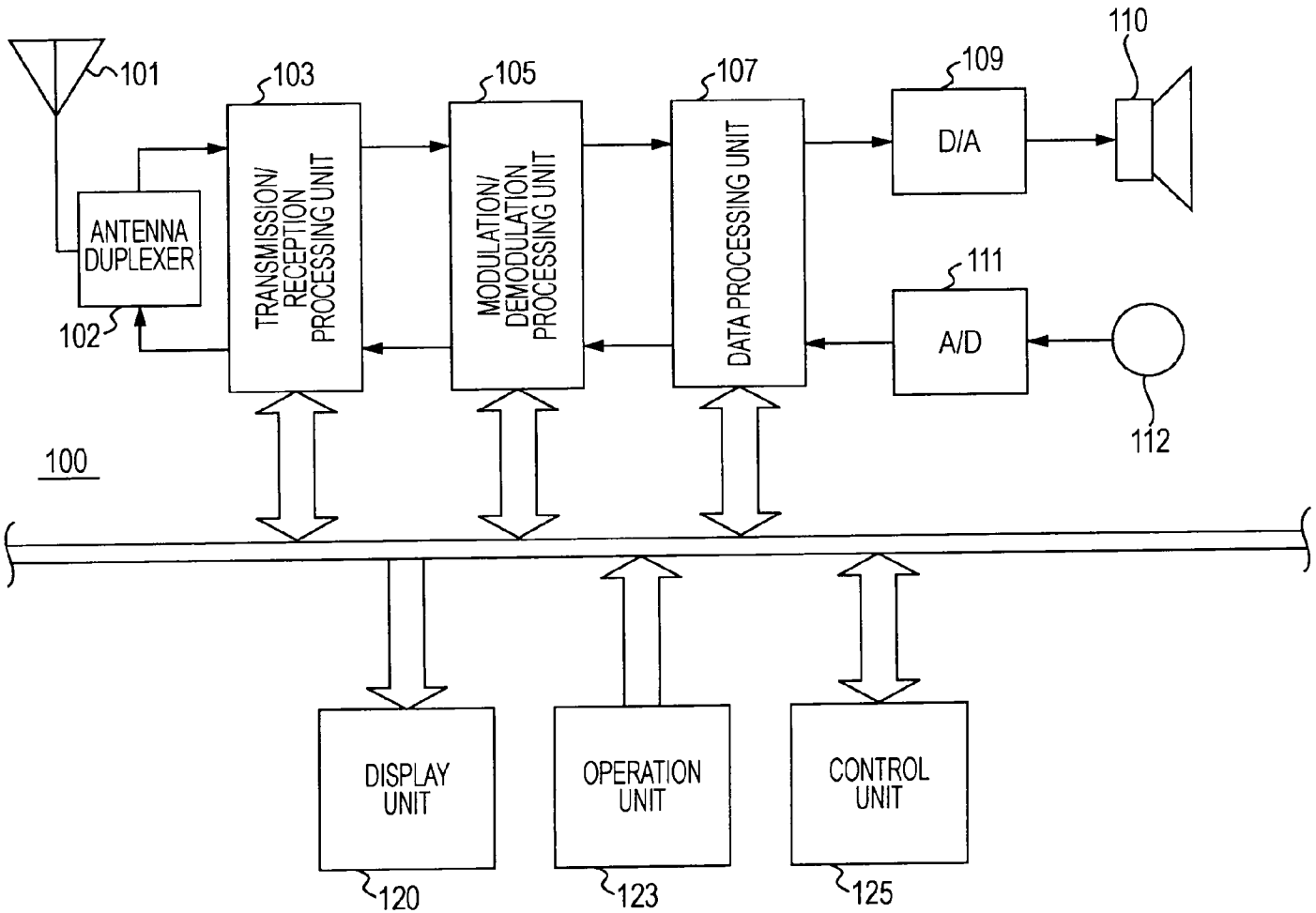
FIG. 10 is a block diagram showing a schematic structure of a communication terminal apparatus according to an embodiment of the present invention.

FIG. 10 shows a schematic structure of a communication terminal apparatus 100 which uses the antenna device according to the embodiment. A portable telephone terminal is shown by way of example, but not limitation. The communication terminal apparatus 100 includes an antenna device 101 having any of the structures described above, an antenna duplexer 102 for sharing the antenna device 101 between transmission and reception, a transmission/reception processing unit 103, a modulation/demodulation processing unit 105, a data processing unit 107, a D/A converter 109, a speaker 110, an A/D converter 111, and a microphone 112. The communication terminal apparatus 100 further includes a control unit 125 including a CPU, a ROM, etc., for controlling those components, a memory 127 used as a work area or a temporary storage area by the control unit 125, a display unit 120, and an operation unit 123. A read-only memory or an electrically data writable and erasable read-only memory (EEPROM) is used in the ROM of the control unit 125, and a control programs for various operations of a standard communication terminal apparatus, such as reception of operation inputs, communication, electronic mail processing, web processing, display, audio input/output, address-book management, and schedule management, and static data are stored.

While a preferred embodiment of the present invention has been described, various modifications and variations other than those described above may be made.

According to a multi-band antenna device of the present invention, since no parasitic element is used, loss in radiation efficiency is low, and improvement in antenna performance can be realized. Moreover, it is not necessary to use a contact pin for a parasitic element, and reduction in cost of the apparatus can be realized.

Furthermore, with the adoption of a structure in which at least a major part of the antenna radiating plate does not face the ground plate, the size (thickness) of the antenna device is reduced, which thus contributes to reduction in the thickness of a communication terminal apparatus including the antenna device incorporated therein. In addition, the amount of current flowing in the ground plate is small, and the so-called hand effect can be reduced.

The invention claimed is:

1. An inverted f-type multi-band antenna device comprising:

an antenna radiating plate having a feed point and a GND point, and a ground plate, wherein the antenna radiating plate is configured such that the feed point and the GND point are electrically distant from each other, that at least three antenna elements are formed, and the antenna radiating plate projects through the outside of the ground plate with respect to the feed point and the GND point so that at least a major part of the antenna radiating plate does not face the ground plate, and at least three resonance points that support communications in at least three communications bands are generated in correspondence with the at least three antenna elements.

2. The multi-band antenna device according to claim 1, characterized in that a slit is formed between the feed point and GND point of the antenna radiating plate.

3. A communication terminal apparatus characterized by comprising an inverted f-type multi-band antenna device, the multi-band antenna device including an antenna radiating plate having a feed point and a GND point, and a ground plate, wherein the antenna radiating plate is configured such that the feed point and the GND point are electrically distant from each other, that at least three antenna elements are formed, and the antenna radiating plate projects through the outside of the ground plate with respect to the feed point and the GND point so that at least a major part of the antenna radiating plate does not face the ground plate, and at least three resonance points that support communications in at least three communications bands are generated in correspondence with the at least three antenna elements.

4. An inverted f-type multi-band antenna comprising:

a ground plate; and an antenna radiating plate having a feed point and a ground point, the antenna radiating plate projecting through the outside of the ground plate with respect to the feed point and the ground point so that a major part of the antenna radiating plate does not face the ground plate, wherein the antenna radiating plate includes at least three antenna elements, and the feed point and the ground point of the antenna radiating plate being are electrically distant from one another, wherein at least three resonance points that support communications in at least three communications bands are generated in correspondence with the at least three antenna elements.

* * * * *